United States Patent [19]

Theis, Jr.

[11] 3,976,389

[45] Aug. 24, 1976

[54] PRESSURIZED GAS ENGINE

[75] Inventor: James V. Theis, Jr., Delray Beach, Fla.

[73] Assignee: Hollymatic Corporation, Park Forest, Ill.

[22] Filed: Feb. 28, 1975

[21] Appl. No.: 553,978

Related U.S. Application Data

[63] Continuation-in-part of Ser. Nos. 405,092, Oct. 10, 1973, and Ser. No. 464,364, April 26, 1974, abandoned.

[52] U.S. Cl. ..... 415/25; 415/80; 415/92; 91/366; 91/458; 137/58; 173/12

[51] Int. Cl.[2] ..... F01B 25/06

[58] Field of Search ..... 415/80, 82, 92, 25; 173/12; 91/458, 366; 137/58

[56] References Cited

UNITED STATES PATENTS

| | | | |
|---|---|---|---|
| 2,752,145 | 6/1956 | Hill et al. | 91/336 |
| 3,225,540 | 12/1965 | Alsobrooks et al. | 91/458 |
| 3,315,754 | 4/1967 | Holdo et al. | 173/12 |
| 3,608,131 | 9/1971 | Hornschuch et al. | 173/12 |
| 3,797,335 | 3/1974 | Amtsberg | 415/25 |
| 3,904,305 | 9/1975 | Boyd | 415/25 |

*Primary Examiner*—C. J. Husar

*Attorney, Agent, or Firm*—Wegner, Stellman, McCord, Wiles & Wood

[57] ABSTRACT

A pressure gas engine in which pressurized gas such as air is supplied to a series of arcuately arranged nozzles for exhausting into a series of arcuately arranged impulse buckets thereby causing rotation of a rotor in which the buckets are located, each nozzle having an exit adjacent the buckets and each bucket having a curved surface with an entering boundary edge and a leaving boundary edge for the gas blast leaving the bucket so that the blast sweeps across the curved surface of each bucket. The exit diameter of each nozzle is less than the radius of the curved surface of each bucket to achieve a full sweep of each bucket's curved surface from the entering edge to the leaving edge.

The disclosure also includes means providing a pressurized gas supply passage to the nozzles, a control valve in this passage comprising a valve seat and a movable valve movable toward and away from the seat to control the gas flow through the passage to the nozzles, a gas bleed passage that diverts a portion of the pressurized gas from the supply passage to the back side of the valve opposite the seat to provide valve closing back pressure on the valve and through a bleed vent valve comprising a vent valve seat in the bleed passage and a movable vent valve member movable into and away from engagement with the vent valve seat to control this back pressure on the air supply control valve and centrifugally responsive means rotatable with the rotor of the engine for moving the vent valve member toward its seat on increasing speeds of the rotor thereby increasing and decreasing the pressure on the movable control valve to control the gas supply to the nozzles.

5 Claims, 16 Drawing Figures

Fig. 4
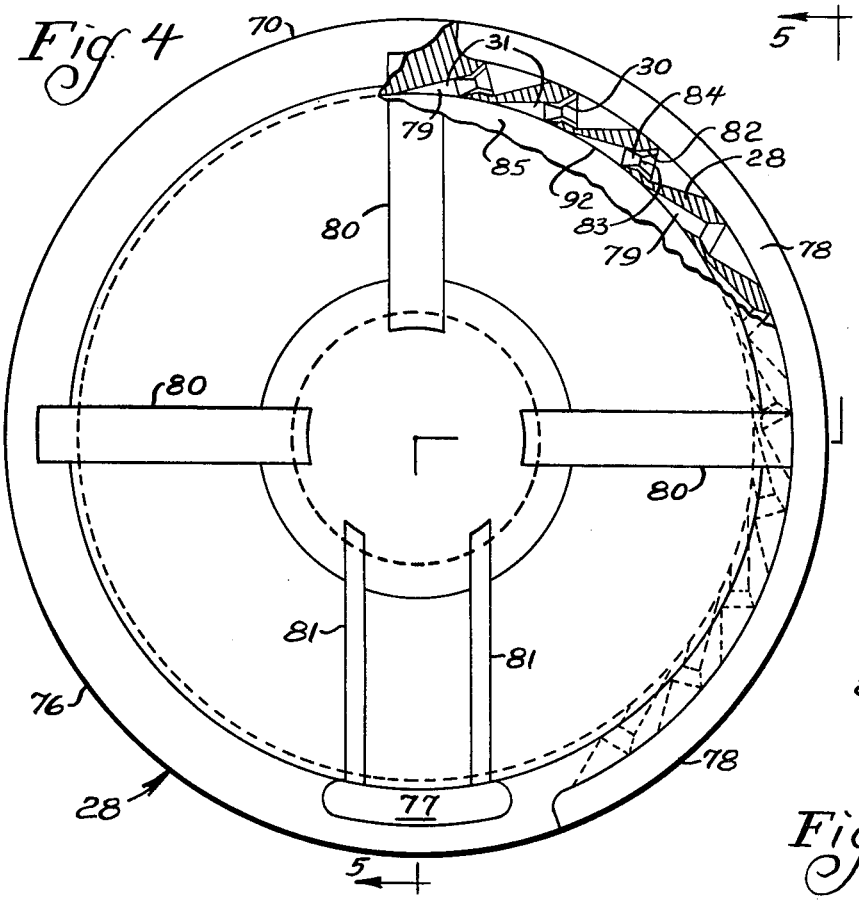
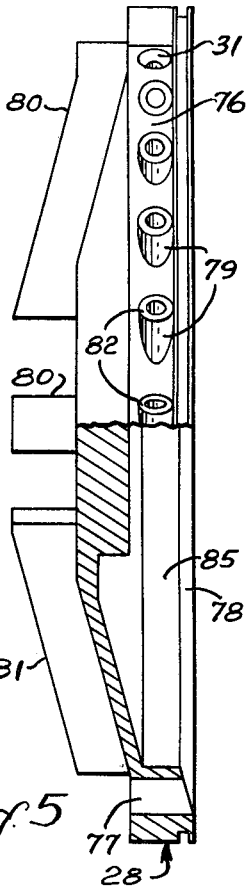
Fig. 5
Fig. 6
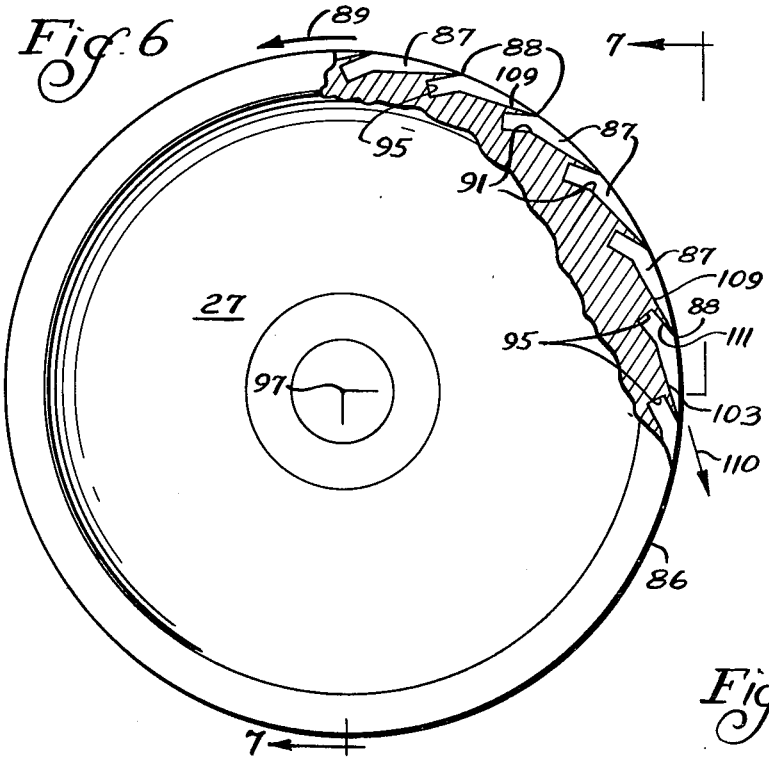
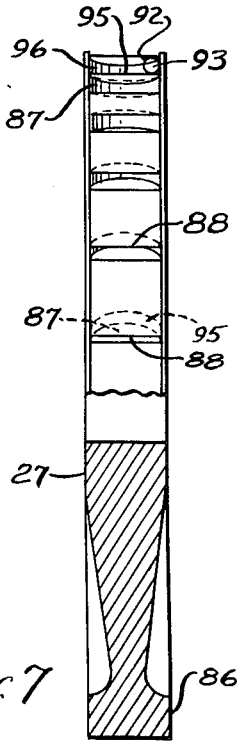
Fig. 7

Fig. 10
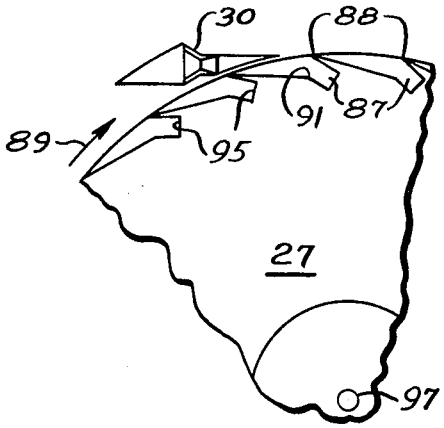
Fig. 11
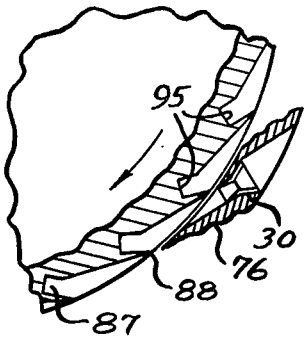
Fig. 12
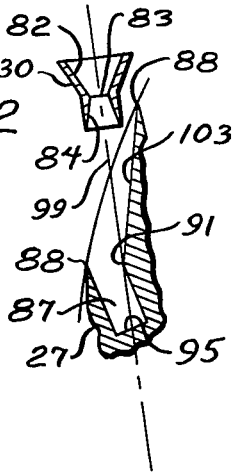
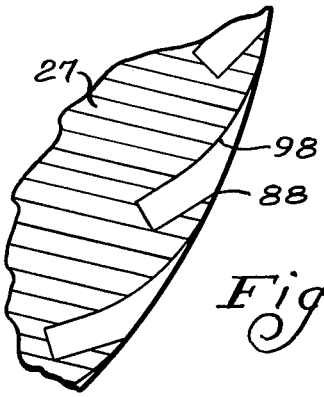
Fig. 13
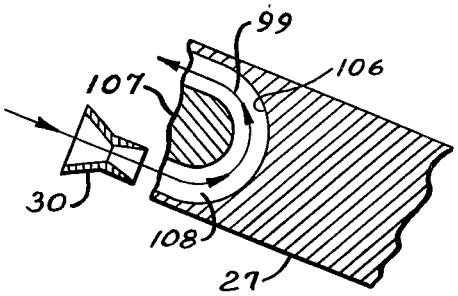
Fig. 14

PRESSURIZED GAS ENGINE

CROSS-REFERENCE TO RELATED APPLICATIONS

This application is a continuation-in-part of my co-pending applications Ser. No. 405,092, filed Oct. 10, 1973, and Ser. No. 464,364, filed Apr. 26, 1974 now abandoned.

BACKGROUND OF THE INVENTION

This invention relates to a pressure gas engine having a rotor, a plurality of adjacent and arcuately arranged fixed nozzles exhausting into adjacent arcuately arranged impulse buckets located in the rotor with each bucket having a curved impulse surface across which the high velocity gas sweeps in imparting rotational energy to the rotor.

Another feature of the invention is to provide a pressure gas engine in which the supply of gas to the engine is controlled by a movable valve, a portion of the pressurized gas is bypassed as bleed gas around the valve seat to the rear of the valve to provide valve closing back pressure thereon, a bleed passage from this back pressure side of the valve to increase or decrease the valve closing back pressure and centrifugally responsive means for opening and closing this bleed passage as a function of the speed of rotation of the rotor to control the position of the valve and thus the supply of pressure gas to the engine.

BRIEF DESCRIPTION OF THE DRAWINGS

FIG. 4 is an elevational view of the stator 28 partially in section to show the passages 79 in which the nozzles 101 are located.

FIG. 5 is a sectional view taken substantially along line 5—5 of FIG. 4.

FIG. 6 is a side elevational view partially in section of the rotor of the embodiment of FIG. 1.

FIG. 7 is a sectional view taken substantially along line 7—7 of FIG. 6.

FIG. 10 is a fragmentary semi-schematic view illustrating the relationship of the impulse buckets of the rotor of this embodiment to a fixed nozzle.

FIG. 11 is a fragmentary view illustrating one embodiment of the buckets and particularly the side surfaces thereof.

FIG. 12 is a schematic view illustrating the angular relationship of a nozzle and an impulse bucket of the embodiment of FIG. 11.

FIG. 13 is a view similar to FIG. 11 but illustrating another embodiment of the buckets.

FIG. 14 is a schematic view of a second embodiment of the buckets and a nozzle of the invention.

DESCRIPTION OF THE PREFERRED EMBODIMENTS

Figure 1:
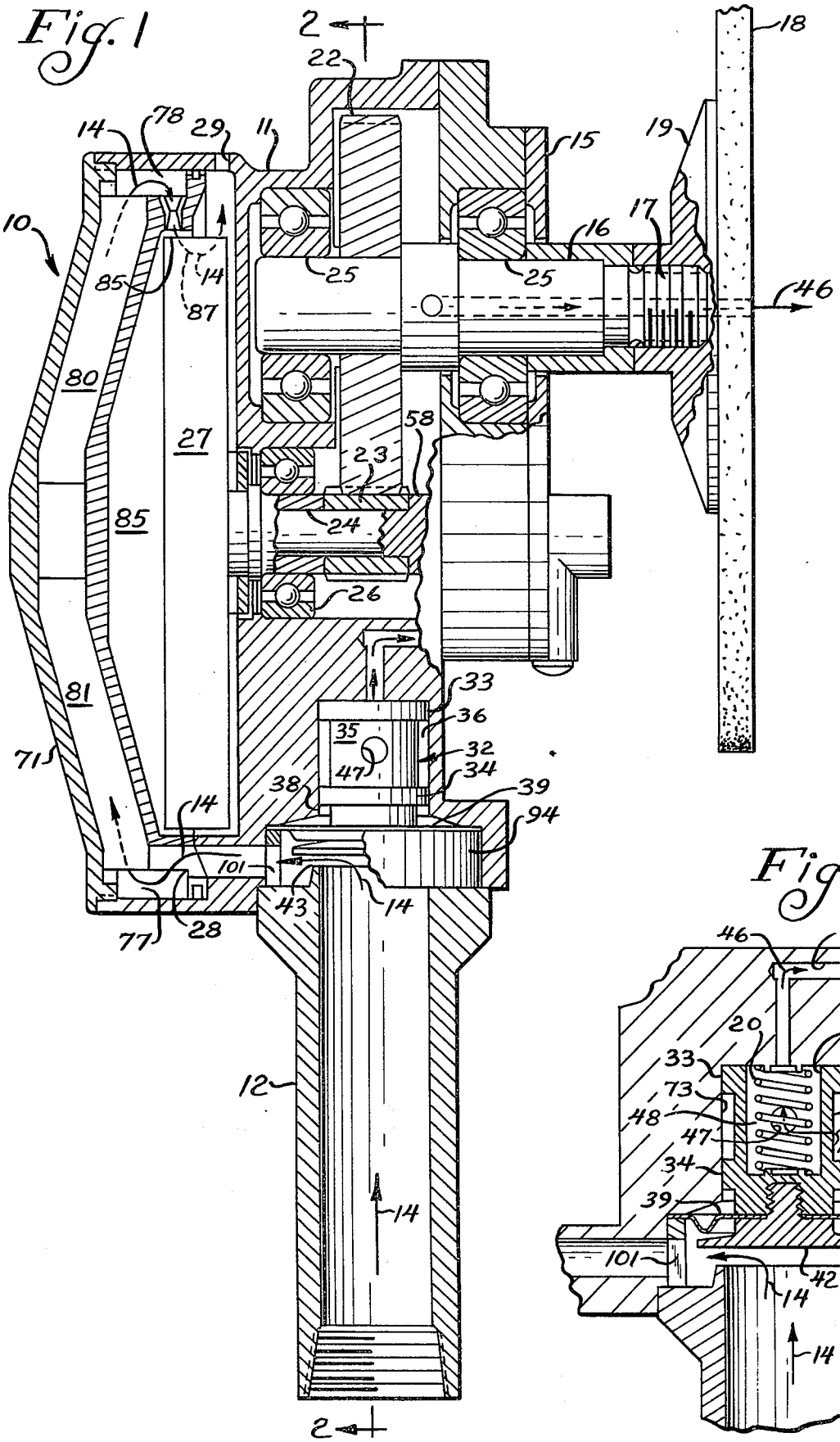
FIG. 1 is a longitudinal sectional view taken through the center of one embodiment of the invention.

In the first embodiment of the invention as illustrated in FIGS. 1–10 the gas engine 10 comprises a casing 11 having two angularly arranged handles 12 and 13 extending radially from the generally circular casing 11. One of the handles 12 serves as a conduit for the flowing pressurized gas identified schematically by the arrow 14.

Mounted in the casing 11 and extending through a side plate 15 thereof is a drive shaft 16 rotatably mounted in the usual manner and having attached to the outer end 17 thereof in the customary manner a flat abrasive grinding disc 18 of the customary type.

The shaft 16 and thus the disc 18 mounted thereon by the mounting head 19 is rotated by a gear 22 attached to the shaft 16 and rotated by engagement with a smaller gear 23 that is a part of a main drive shaft 24 arranged generally parallel to the disc drive shaft 16. Each of the shafts 16 and 24 is mounted for rotation in a corresponding pair of spaced ball bearings 25 and 26 mounted in the casing 11.

Mounted on one end of the main drive shaft 24 is a rotor 27 that is shown only schematically in FIG. 1 but is illustrated in detail in the later figures as described hereinafter.

Figure 3:
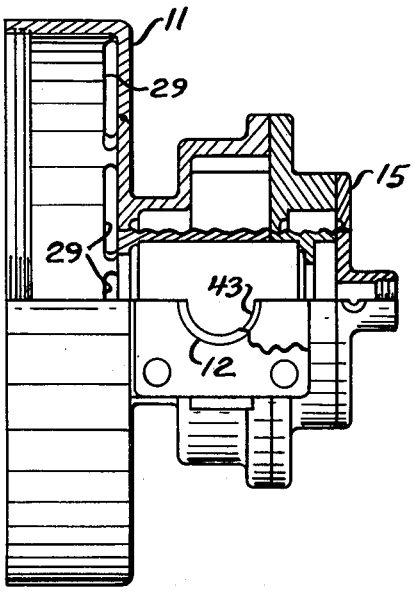
FIG. 3 is a combined sectional and elevational view of the housing of FIG. 2 as viewed from line 3—3 of FIG. 2.

The rotor 27 is rotated by the pressurized gas 14 such as compressed air at 80–100 psig that flows into and through a series of nozzles 30 in openings 79 in a stator plate 28, also shown only schematically in FIG. 1 but illustrated in more detail and described hereinafter. The pressurized gas 14 flows as indicated by the arrows and exits through elongated and peripherally aligned slots 29 in the casing 11 (FIG. 3).

Figure 15:
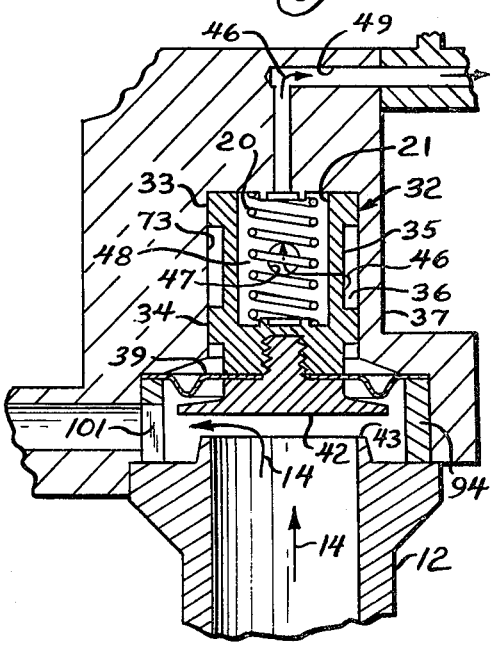
FIG. 15 is a fragmentary sectional view similar to a portion of FIG. 1 and taken through the valve body and associated structure comprising a portion of the speed control.

The flow of gas to the rotor 27 and thus the speed thereof is controlled by a governor that comprises a cylindrical valve 32 of generally spool shape having an annular end 33 and a similarly annular intermediate section 34 on a body 35 therebetween and of a smaller diameter so as to provide an annular space 36 between the valve body 35 and the casing portion 37 in which it is slidably retained for movement in a longitudinal direction. The end 38 of the valve 32 opposite the annular end 33 has a flat surface 42 that operates as a sealing surface against an annular valve seat 43 when the valve is moved downwardly in FIG. 1 from the fully open position shown to fully closed position where the surface 42 is in engagement with the annular valve seat 43 to block the flow 14 of pressure gas. A compression spring 20 is provided within an end opening hollow interior 21 of the valve body 35 opposite the valve seat surface 42 urging the valve toward closed position as illustrated in FIG. 15. There is also provided a transverse diaphragm 39 in order to block leakage of gas pressure from around the control valve 32 toward the valve seat 43 and vice versa.

In order to anchor the outer edge of this diaphragm 39 there is also provided a cylindrical retainer 94 provided with a gas flow slot 101 as shown in FIG. 15 in order to permit the gas flow 14.

Figure 16:
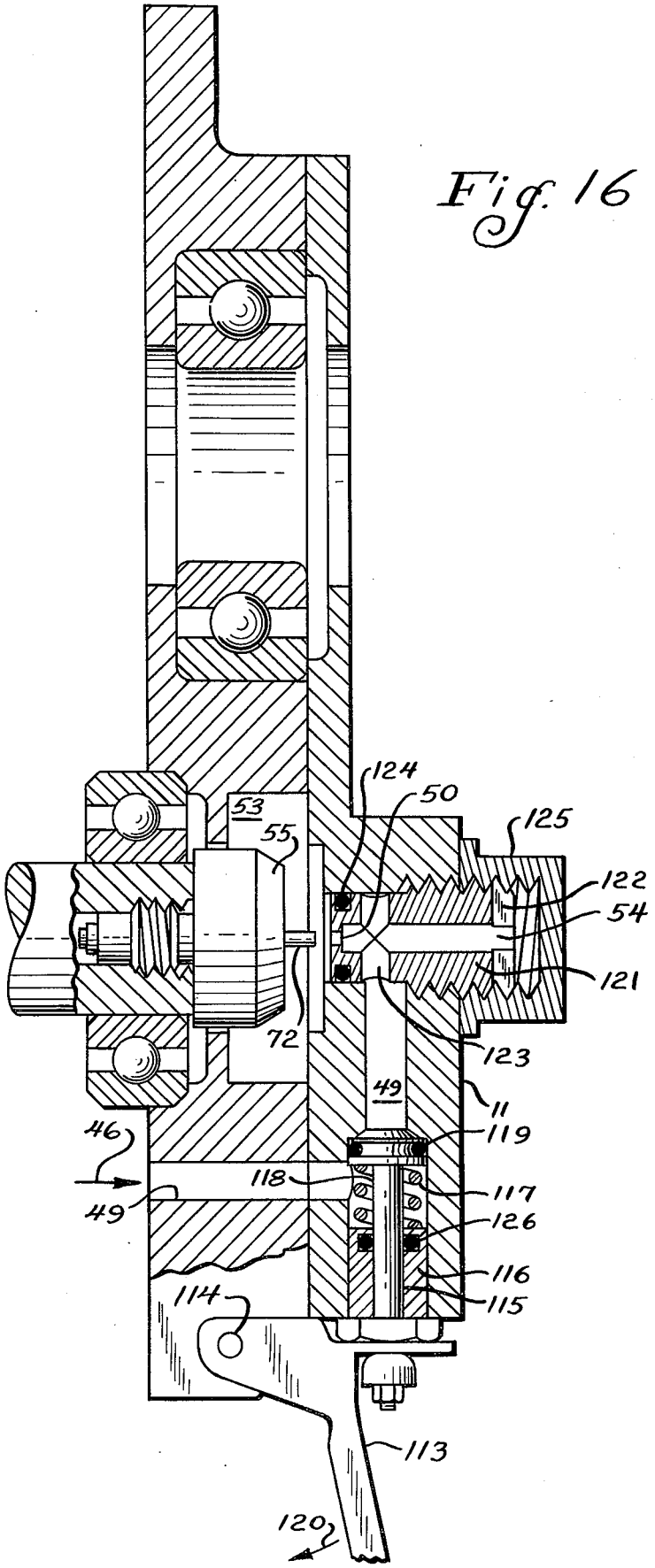
FIG. 16 is a detail sectional view of a portion of FIG. 1.

In order to provide valve closing pressure on the valve 32 the inlet handle 12 (FIG. 2) and the adjacent section 44 of the casing 11 is provided with a gas bleed passage 45 that bleeds a gas stream portion 46 from the main gas flow 14. This gas stream 46 flows through a filter 75 (FIG. 2), a metering hole 74, into and around the space 36 (FIG. 1) surrounding the body 35 of the valve 32, inwardly through a pair of diametrically oppositely located holes 47 into the hollow interior 48 of the valve 32 and from there into a bleed passage 49 leading to a flow restricting orifice 50, and from there into a surrounding space 53 and to the atmosphere as shown in FIG. 16. The orifice 50 is adapted to be partially closed by a stem 72 on a vent valve member 55 as explained hereinafter.

Figure 8:
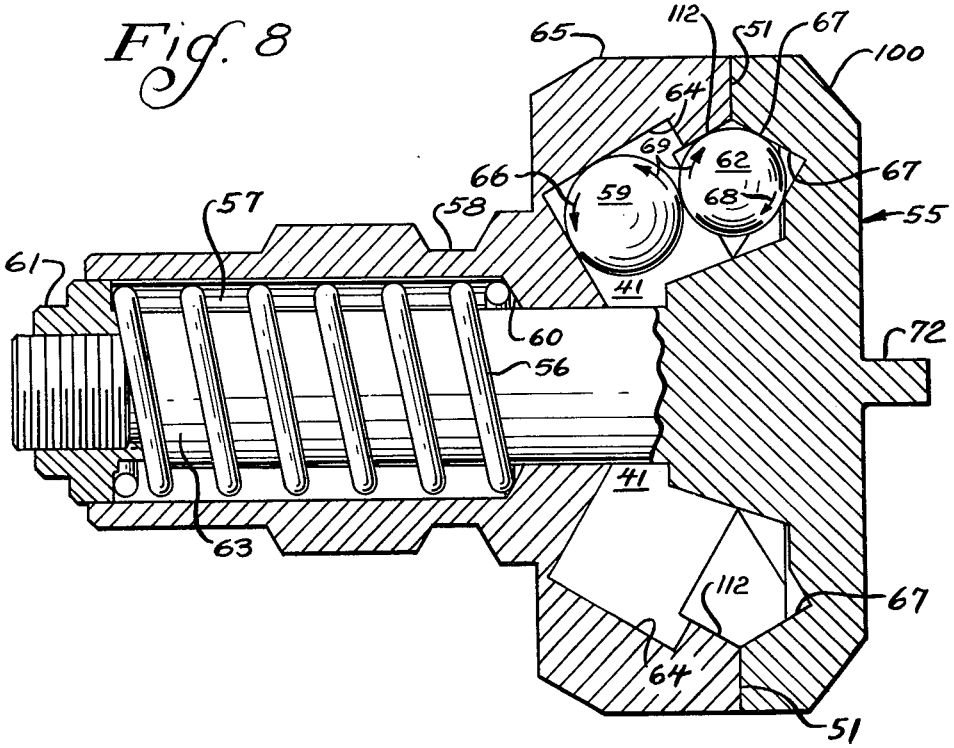
FIG. 8 is an enlarged sectional detail illustrating the governor actuating portion of the engine.

Flow into and through the axial terminal portion 54 and orifice 50 is controlled by the movable vent valve member 55 that is movably longitudinally (horizontally in FIG. 1) into and out of engagement with the valve seat orifice 50. This vent valve member 55 which is shown in enlarged detail in FIG. 8 is urged toward open position or to the left in FIGS. 8 and 16 by a coaxial helical spring 56 in a spring chamber 57 that is coaxial with a fixed generally cylindrical vent valve body 58. The spring 56 which urges the vent valve 55 toward open position bears against a base section 60 in the valve body 58 and an axially adjustable threaded closure or nut 61 on the end of valve stem 63.

In order to provide valve closing pressure the vent valve member 55 is provided with a plurality of pairs of centrifugally responsive balls 59 and 62 of which there are two equally spaced pairs in the illustrated embodiment. Each pair of balls 59 and 62 is located against an outwardly inclined stepped surface 64 and 112 each of which defines the outer surface of a ball-retaining groove 41. Each groove 41 extends into both the vent valve member end 100 and the adjacent end 65 of the valve body 58 and functions to hold its pair of balls against substantial arcuate displacement.

Increasing centrifugal force of increasing speeds of rotation of the rotor 27 tends to move each of the plurality of pairs of balls 59 and 62 generally radially outwardly because of the rolling contact with the stepped surfaces 64, 112 and 67, and this overcomes the spring 56 force to urge the vent valve member 55 toward valve closing position or to the right in FIGS. 1 and 8 to block bleed gas flow through the orifice 50 of the axial opening 54.

FIG. 8 shows only a single pair of balls 59 and 62 although another pair of exactly the same size and relationship is omitted from the bottom of FIG. 8 in the groove space 41 for clarity of illustration. The purpose of each large ball 59 is to remove the frictional load of the ball 62 on its surface 112. This surface is illustrated at the top of FIG. 8 with the ball 62 in contact therewith and is illustrated more clearly at the bottom of FIG. 8 where the ball is omitted as noted above. This frictional load of each ball 62 on the contacted surface 112 results from the outward component of force on the balls 62. This ball 62 to surface 112 contact is only very slight because of the force exerted on each ball 62 by the corresponding ball 59 and this transfers the otherwise heavy radial force of ball 62 which would be exerted on surface 112 to surface 67 which is shown in FIG. 8 as a part of the vent valve body end 100.

As is shown in enlarged sectional detail in FIG. 16 the engine 10 is started and stopped by a lever 113. This lever is fulcrumed to the casing at 114 and is attached to a longitudinally movable valve stem 115 located at a right angled intersection of two portions of the bleed passage 49 that leads from the main control valve chamber 73 as previously described. This stem 115 is slidable in a cylinder 116, is sealed thereto by an O-ring 126 and is urged toward closed position or into the casing 11 by a helical compression spring 117 that extends between the fixed tube 116 and an inner head 118 on the stem 115 which is slidably sealed to the inner end of the chamber in which the spring 117 is located by an O-ring seal 119. When the lever 113 is released as shown in FIG. 16 the spring 117 therefore holds the valve stem 115 in closed position as shown.

With the valve 115–119 in closed position flow of the bleed air 46 is of course blocked by the O-ring seal 119. This sets up a back pressure on the main control valve 32 (FIG. 1) moving it to seat on valve seat 43 thereby completely blocking gas flow 14 to the rotor. When the lever 113 is moved toward fully open position as indicated in FIG. 16 by the arrow 120 the valve ring 119 (FIG. 16) is moved in a corresponding direction to open the bleed passage 49 for resumption of flow of bleed air 46. As pointed out above, the rotation of the rotor increasing the centrifugal force of the plurality of pairs of bells 59 and 62 forces them outwardly thereby overcoming the spring 56 force and urging the member 55 toward orifice 50 restricting position or outwardly in FIG. 16.

This substantial restricting of flow through the orifice 50 at maximum speed by the stem 72 on the vent valve member 55 interrupts the bleed gas stream 46 flow thereby increasing back pressure on the main control valve 32 to move it toward the gas supply valve seat 43 thereby interrupting gas 14 flow to the rotor 27 by way of the stator 28 and thereby to regulate the speed of the rotor 27 to a preset maximum.

The bleed gas orifice 50 as shown in FIG. 16 is part of a threaded plug 121 that is threaded into the side of the portion of the casing 11 shown in FIG. 16. This plug 121 is sealed at its inner end by an O-ring 124 and has an end cross slot 122 for convenience in adjusting the longitudinal position of the plug 121. This serves to preset the maximum speed adjustment by positioning the orifice 50 relative to the stem 72. The passage 123 intersects the longitudinal passage 54 in the plug 121 which is coaxial with stem 72 and bleed gas orifice 50. The end of the passage 54 opposite the orifice 50 is sealed by a threaded cap 125 which also acts as a lock nut on the threaded plug 121.

In order to prevent binding the stem 72 is slightly smaller than the orifice 50. In the illustrated embodiment the stem 72 is approximately 0.002 inches smaller than the diameter of the orifice 50.

Figure 2:
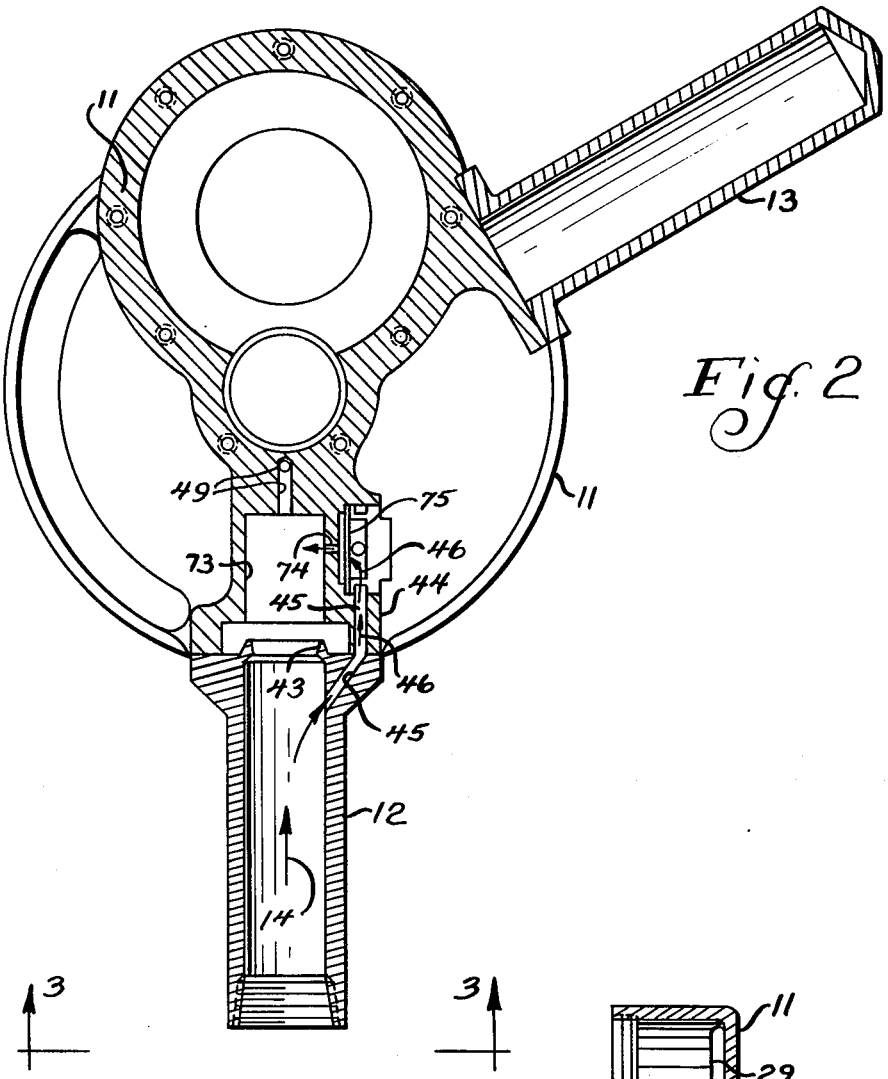
FIG. 2 is a longitudinal sectional view taken through the housing only of the engine substantially along line 2—2 of FIG. 1.

As is shown in FIG. 2 the flow of bleed gas 46 into the valve chamber 73 (in which the piston valve 32 is located) for providing back pressure on the valve is through a metering hole 74 which accurately controls the amount of bleed air that is withdrawn from the main air stream 14 as discussed above. In one embodiment where the air pressure was the above noted 80–100 psig this metering hole 74 was 0.032 inch in diameter. Also as indicated in FIG. 2 the bleed air stream 46 is passed through a fine mesh filter 75 to remove any solid particles that might tend to block partially or completely the flow of pressure gas through the metering hole 74.

As can be seen from the above description the governor valve 32 and the auxiliary vent valve 55 and associated structure are simple in operation and the main valve 32 may be positioned anywhere within the gas supply to the engine. Furthermore, because the valve opening and closing action is controlled by the actuator vent valve 55 which is centrifugally responsive the valve is very sharp in its action. Thus in one embodiment the vent valve 55 moves only a maximum of 0.007 inch from one end of its movement to the other in controlling the main valve 32 and thus the speed of the engine. During the movement of valve 55 through the 0.007 inch, the main valve 32 moved 0.187 inch. With the governor of this invention there is therefore very little override in controlling the speed.

Thus in governing the speed of rotation of the rotor 27 of one embodiment of this invention the speed was accurately controlled both under full load and no load conditions at between 28,800 and 28,300 rpm so that the entire speed variation range (500 rpm) was a very small percentage (1.74%) of the maximum speed.

The stator 28 comprises a nozzle plate 70 having a peripheral rim 76 that is provided in one portion with an opening 77 to a rim recess 78 which arcuately coincides with the arcuate location of the openings 79 in which are located the nozzles 30. Each nozzle is supplied with gas 14 from the recess 78 into a converging outer end 82, through the throat 83 and inwardly through the diverging end 84 as illustrated in FIG. 4. As can be seen there, each nozzle 30 lies on a chord of the plate 70 that is less than the plate diameter and all nozzles exhaust inwardly into the space 85 in which is located the rotor 27. The outer side of the nozzle plate 70 is closed by the cap plate 71 which defines an outer side of the opening 77 and recess 78. The plate 70 is provided with radial ribs 80 and 81 (FIGS. 1 and 4).

Located within this space 85 for rotation imparting velocity contact with the inwardly flowing gas streams 99 (FIG. 12) through the arcuate series of nozzles 30 is the rotor 27 which is provided around its entire periphery 86 with first energy conversion means in the form of a series of impulse buckets 87. These buckets convert the dynamic gas momentum of the supersonic gas stream 99 to power which is embodied in the rotating rotor and the parts connected thereto. The stator 28 therefore which closely surrounds the rotor has a series of nozzles 30 extending arcuately for 150° and constitutes in this embodiment second energy conversion means adjacent to and facing the first means (buckets) 87. These nozzles convert gas pressure to supersonic velocity primarily by reducing the gas pressure in such a way as to greatly increase gas velocity. Because of the converging-diverging nature of the nozzles they provide substantially straight line blasts of supersonic gas (e.g., air) directly into the buckets for high efficiency conversion of gas pressure into rotary power.

Figure 9:
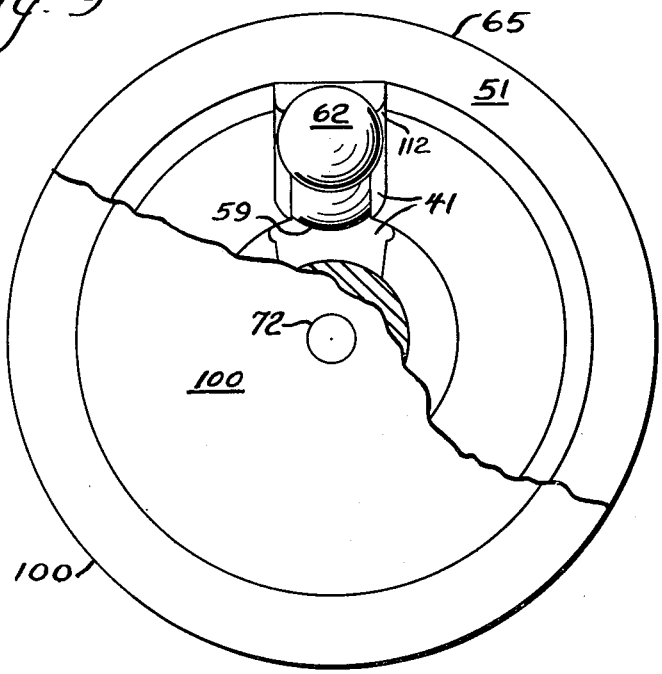
FIG. 9 is an end elevational view partially broken away of the right end of FIG. 8.

As is shown in FIG. 6 the wall 109 between each adjacent pair of buckets 87 tapers to a knife edge 88 for dividing the gas blasts 99 from the nozzles 30 into the buckets as the rotor is rotated which in this embodiment is in a counterclockwise direction 89 as viewed in FIG. 6 and clockwise as viewed in FIGS. 9 and 11.

As shown schematically in FIG. 7 the diverging exhaust end 92 of each nozzle 30 is located adjacent to one edge 93 of an impulse bucket 87 when the rotor is in position so that the full blast 99 (FIG. 12) of gas is received in each bucket. The impulse surface 95 of each bucket (which in the illustrated embodiment curves for 180° from edge 93 to opposite edge 96) directs the gas blast 99 along each surface 95 and exhausts from the opposite edge 96. This flow is without major velocity losses with respect to the buckets because of the converging-diverging nature of the nozzles and the provision of the knife edges 88, the bucket surfaces 91 (FIGS. 6 and 12), the arcuate impulse surfaces 95 and the entering of the blast at one side 93 of the surface 95 and the exhaust from the opposite side 96. The combination of these factors results in smooth flow of the gas into and out of all buckets with a resulting highly efficient conversion of pressure of the gas to rotary power of the rotor. In this embodiment each bucket has the impulse surface 95 extending at a constant radius for about 180°.

The side 91 (FIGS. 10 and 12) of each bucket that is nearer the axis of rotation 97 is bent either angularly as shown at 91 in FIGS. 6, 10 and 12 or smoothly as shown at 98 in the embodiment of FIG. 13. The result of this as can be noted by the gas blast 99 in FIG. 12 is that these curved surfaces are believed to function as suction surfaces to allow gas to enter and exit the buckets more nearly tangent to the outside circumference of the rotor and to impart an additional rotational force which is additive with the impulse imparted rotation as previously described.

In order to greatly reduce or even prevent velocity losses with respect to buckets FIG. 14 illustrates another embodiment of the impulse buckets in which here the bucket surface 106 has spaced therefrom an arcuate insert 107 so as to provide a controlled flow passage 108 therebetween. This passage can be either of constant cross sectional area, converging-diverging, converging only, diverging only and can change in shape or cross section from square to round, square to round to oval or any desirable change in shape in progressing through the passage.

The gas engine or turbine of this invention provides power with extremely high efficiency in converting the available energy of the pressurized gas to rotational power. The providing of the knife edge 88 between the adjacent pairs of impulse buckets does not interrupt or dissipate the gas blast from each nozzle as the series of buckets passes into and out of alignment with each nozzle.

The engine of this invention provides a very high efficiency conversion of gas pressure to power and particularly rotary power. This is accomplished primarily by making full use of the high velocity jets of gas, in this embodiment air, that are emitted by the stationary nozzles 30. In order to utilize this high velocity gas blast at the highest efficiency this invention achieves the following operational results: Substantially all of the gas emitted by the nozzles and illustrated by the blast 99 in FIG. 12 enters the buckets as they are rotated past the nozzles. Also, as small an amount as possible of the gas velocity illustrated by the blast 99 in FIG. 12 is dissipated with respect to the buckets once the gas enters the buckets 87. In addition, the gas enters and leaves each bucket in streams that are as close to being tangent to the outside diameter of the rotor as possible.

Thus, as illustrated in FIGS. 6 and 7, the successive buckets 87 around the periphery 86 of the rotor 27 are separated by the thin walls with each wall defined on its outer extremity by the knife edge 88. This results in very little of the gas stream from each nozzle being dissipated laterally as by impinging against a flat surface as would be the case if the knife edges were not used. Therefore, the individual gas blasts 99 enter with full velocity into the buckets of the rotating rotor.

As there is this lack of sideways and other detrimental deflection of the gas blast, and since the high velocity gas exiting the diverging section of the nozzle is at atmospheric pressure, the tolerance between the rotor 27 and the stator 28 of the engine of this invention can be quite loose. This is a new development in gas pressure turbines as the customary turbine tends to dissipate the gas stream so that in order to achieve any respectable efficiencies the tolerances must be extremely close. As stated, this is not the situation with the turbine of pressure gas engine of the present invention.

Tests have shown that the angle of the exhaust gas with respect to the rotor 27 should be as close as possible to a tangent of a circle defined by the periphery 86 of the rotor as this directly influences the power output of the rotor. Thus the closer to a tangent that the exhaust is the better the conversion of gas pressure to power exemplified in the rotary power of the rotor 27. As is shown in FIGS. 6 and 12 the surface 103 is angled or curved in the region between the knife edge 88 and the impulse surface 95 of each bucket so that the exiting gas stream identified in FIG. 6 by the arrow 110 is as close as possible to the periphery 86 of the rotor.

Thus the basic reason for providing the knife edges 88 between adjacent buckets as the periphery thereof is, first, these knife edges permit all of the pressurized gas 99 to blast into the buckets and flow along the impulse surfaces 95 and, second, it provides a top 111 for each bucket that prevents the direct escape of gas from each bucket once it has entered inwardly beyond the knife edge 88. This escape of high velocity gas from the rotating buckets is a common problem with low aspect ratio buckets of present turbines.

Having described my invention as related to the embodiments shown in the accompanying drawings, it is my intention that the invention be not limited by any of the details of description, unless otherwise specified, but rather be construed broadly within its spirit and scope as set out in the appended claims.

I claim:

1. A pressure gas engine, comprising: an inner first member having a generally circular periphery with first energy conversion means at said periphery for converting dynamic gas pressure to power; an outer second member closely surrounding said first member and having second energy conversion means adjacent to and facing said first conversion means also for converting dynamic gas pressure to power, the energy conversion means in one said member comprising an arcuately adjacent series of gas nozzles exhausting toward the other energy conversion means to provide a substantially straight line blast of gas into said other energy conversion means; a pressurized gas supply passage means to said nozzles; control means for said pressurized gas comprising a valve seat in said passage means and a force movable valve movable toward and away from said seat to control the gas flow through said passage means; means for diverting a portion of said pressurized gas from its supply passage means to the back side of said movable valve opposite the seat to provide valve closing back pressure on said valve and through a venting bleed valve comprising a vent valve seat in a bleed passage leading from said opposite side of said valve to the exterior and a movable vent valve member movable into and away from engagement with said vent valve seat; centrifugally responsive means rotatable with said rotor for moving said vent valve member toward said vent valve seat on increasing speeds of said rotor, thereby increasing and decreasing the valve closing back pressure on said movable valve to control the gas supply to said nozzles; and supplemental resilient means for providing additional valve closing back pressure on said movable valve.

2. The engine of claim 1 wherein said centrifugally responsive means comprises a plurality of pairs of contacting balls spaced around the axis of rotation of said rotor with one of each pair bearing against an outwardly inclined surface adjacent to said vent valve member and the other of said balls bearing against an oppositely inclined surface on said vent valve member whereby increasing speeds of rotation cause said balls to roll against each other and against said inclined surfaces in an outwardly radial direction to separate relatively said surfaces.

3. The engine of claim 2 wherein said balls are in rolling engagement with each other and with their respective inclined surfaces during increases in speed of rotation of said rotor.

4. A pressure gas engine, comprising: an inner first member having a generally circular periphery with first energy conversion means at said periphery for converting dynamic gas pressure to power; an outer second member closely surrounding said first member and having second energy conversion means adjacent to and facing said first conversion means also for converting dynamic gas pressure to power, the energy conversion means in one said member comprising an arcuately adjacent series of gas nozzles; a pressurized gas supply passage means to said nozzles; control means for said pressurized gas comprising a valve seat in said passage means and a force movable valve movable toward and away from said seat to control the gas flow through said passage means; means for diverting a portion of said pressurized gas from its supply passage means to the back side of said movable valve opposite the seat to provide valve closing back pressure on said valve and through a venting bleed valve comprising a vent valve seat in a bleed passage leading from said opposite side of said valve to the exterior and a movable vent valve member movable into and away from engagement with said vent valve seat; centrifugally responsive means rotatable with said rotor for moving said vent valve member toward said vent valve seat on increasing speeds of said rotor, thereby increasing and decreasing the valve closing back pressure on said movable valve to control the gas supply to said nozzles; and supplemental resilient means for providing additional valve closing back pressure on said movable valve.

5. The engine of claim 4 wherein said centrifugally responsive means comprises a plurality of pairs of contacting balls spaced around the axis of rotation of said rotor with one of each pair bearing against an outwardly inclined surface adjacent to said vent valve member and the other of said balls bearing against an oppositely inclined surface on said vent valve member whereby increasing speeds of rotation cause said balls to roll against each other and against said inclined surfaces in an outwardly radial direction to separate relatively said surfaces.

* * * * *